US009945077B2

(12) United States Patent
Hashiguchi et al.

(10) Patent No.: US 9,945,077 B2
(45) Date of Patent: Apr. 17, 2018

(54) CLUPAK PAPER

(71) Applicant: NIPPON PAPER INDUSTRIES CO., LTD., Kita-ku, Tokyo (JP)

(72) Inventors: Keiko Hashiguchi, Tokyo (JP); Hirofumi Kondo, Tokyo (JP); Hiroaki Noguchi, Tokyo (JP); Yuji Abe, Kushiro (JP); Satoshi Ishikawa, Kushiro (JP); Yukio Shini, Kushiro (JP)

(73) Assignee: NIPPON PAPER INDUSTRIES CO., LTD., Tokyo (JP)

( * ) Notice: Subject to any disclaimer, the term of this patent is extended or adjusted under 35 U.S.C. 154(b) by 0 days.

(21) Appl. No.: 14/901,997

(22) PCT Filed: Jul. 11, 2014

(86) PCT No.: PCT/JP2014/068546
§ 371 (c)(1),
(2) Date: Dec. 29, 2015

(87) PCT Pub. No.: WO2015/008703
PCT Pub. Date: Jan. 22, 2015

(65) Prior Publication Data

US 2016/0355985 A1 Dec. 8, 2016

(30) Foreign Application Priority Data

Jul. 18, 2013 (JP) ..... 2013-149926

(51) Int. Cl.

| | |
|---|---|
| ***D21H 27/00*** | (2006.01) |
| ***D21H 27/10*** | (2006.01) |
| ***D21H 25/00*** | (2006.01) |
| ***D21F 9/00*** | (2006.01) |
| ***D21H 11/04*** | (2006.01) |

(52) U.S. Cl.
CPC ..... *D21H 27/005* (2013.01); *D21F 9/003* (2013.01); *D21H 11/04* (2013.01); *D21H 25/005* (2013.01); *D21H 27/00* (2013.01); *D21H 27/10* (2013.01)

(58) Field of Classification Search
CPC ..... D21H 25/005; D21H 27/10; D21H 27/00; D21H 27/005; D21F 9/003
USPC ..... 162/203
See application file for complete search history.

(56) References Cited

U.S. PATENT DOCUMENTS

| | | | |
|---|---|---|---|
| 3,011,545 | A | 12/1961 | Welsh et al. |
| 3,266,972 | A | 8/1966 | Cramer et al. |

FOREIGN PATENT DOCUMENTS

| | | | |
|---|---|---|---|
| EP | 0124496 | A2 | 11/1984 |
| GB | 1100908 | A | 1/1968 |
| JP | 2000054283 | A | 2/2000 |
| JP | 3180804 | B2 | 6/2001 |
| JP | 2005290590 | A | 10/2005 |
| JP | 2007262603 | A | 10/2007 |
| JP | 4803586 | B2 | 10/2011 |
| WO | 1999002772 | A1 | 1/1999 |

OTHER PUBLICATIONS

International Search Report (ISR) dated Oct. 14, 2014, issued for International application No. PCT/JP2014/068546.
Extended European Search Report (EESR) dated Dec. 16, 2016, issued for European counterpart patent application No. EP14826326.
Notification Concerning Transmittal of International Preliminary Report on Patentability (PCT/IB326) and Notification of Transmittal of Translation of the International Preliminary Report on Patentability (PCT/IB/338) dated Jan. 28, 2016, with with International Preliminary Report on Patentability (PCT/IB/373) and Written Opinion of the International Searching Authority (PCT/ISA/237), for corresponding international application PCT/JP2014/068546.
An Office Action was issued by the European Patent Office, dated Dec. 8, 2017, for European counterpart Application No. 14826326.2.

*Primary Examiner* — Mark Halpern
(74) *Attorney, Agent, or Firm* — Law Office of Katsuhiro Arai

(57) ABSTRACT

Clupak paper is manufactured using a gap-former paper-making machine equipped with a Clupak system, in such a way that its longitudinal tensile energy absorption index and lateral tensile energy absorption index as specified in JIS P8113 become 2.5 J/g or more and 1.0 J/g or more, respectively. The paper has excellent strength characteristics in both the longitudinal and lateral directions, especially in the longitudinal direction so that when the Clupak paper can be processed into a sack, the sack rarely breaks.

8 Claims, No Drawings

CLUPAK PAPER

This application is a 371 of PCT/JP2014/068546 filed 11 Jul. 2014.

TECHNICAL FIELD

The present invention relates to kraft paper using Clupak.

BACKGROUND

Kraft paper is a strong, tough, break-resistant paper manufactured from pulp using the kraft process, and used primarily in heavy packaging applications, as a material for making cardboards, and for envelopes, adhesive tapes, etc. In heavy packaging applications, kraft paper is processed into sacks and filled with several tens of kilograms of cement, rice, flour, and various other products, for example, for storage or transport. Accordingly, kraft paper must be strong enough not to break in sack forms and JIS-P3401 specifies Kraft Paper Types 1 to 5, each covering different applications, etc., and meeting the standardized tensile strength, tear strength, and other characteristics of certain levels or greater.

On the other hand, Clupak refers to equipment that inserts a paper web between a roll and an endless rubber blanket to compress the paper web with a nip bar and the rubber blanket, while at the same time the pre-stretched blanket shrinks to cause the paper web to also shrink and thereby increase its breaking elongation, and this equipment is used to provide increased breaking elongation to kraft paper used in heavy packaging applications as mentioned above.

As for how kraft paper is manufactured using this Clupak (hereinafter referred to as "Clupak paper"), Patent Literature 1 describes kraft paper made with Clupak, whose weight per area is in a range of 73 g/m$^2$ or more but less than 84 g/m$^2$, which meets the standard values under JIS P3412, and whose air permeance as specified in JIS P8117 is 4 to 10 seconds.

Patent Literature 2 describes kraft paper used as a sack-shaped decorative or reinforcement kraft paper characterized in that it comprises a single layer of 95 to 130 g/m$^2$ in basis weight and is creped by a Clupak system to achieve a product of lateral tensile strength and lateral breaking elongation (the latter is measured in compliance with JIS-P8113) of 30 to 65, which is characterized by using material pulp adjusted to have a freeness of between 450 and 650 cc.

BACKGROUND ART LITERATURE

Patent Literature

[Patent Literature 1] Japanese Patent No. 3180804
[Patent Literature 2] Japanese Patent No. 4803586

SUMMARY OF THE INVENTION

Problems to be Solved by the Invention

There is a demand, particularly in heavy packaging applications, for Clupak paper which has been processed into a sack and which does not break easily when used as a cement sack, etc.

In the aforementioned patent literatures, on-top paper-making machines are actually used. However, Clupak paper made with these machines, although it may satisfy the standards for tensile strength, tear strength, etc., does not offer sufficient longitudinal strength and if such Clupak paper is processed into a sack and used as a cement sack, etc., the sack may break, especially when content is filled.

Accordingly, a primary object of the present invention is to obtain Clupak paper offering excellent strength characteristics especially in the longitudinal direction, so that when the Clupak paper is processed into a sack and content is filled, the sack rarely breaks.

Means for Solving the Problems

The inventors of the present invention found that, for Clupak paper to break rarely when processed into and used as a sack, longitudinal strength characteristics are important in addition to such general characteristics as longitudinal breaking elongation and lateral breaking elongation.

The inventors of the present invention also found that Clupak paper offering excellent strength characteristics can be manufactured from pulp material containing pulp beaten at high concentration, using a gap-former paper-making machine equipped with Clupak equipment.

The specifics are as follows:

1. Clupak paper whose longitudinal tensile index and lateral tensile index as specified in JIS P8113: 2006 are 60 N·m/g or more and 28 N·m/g or more, respectively.
2. Clupak paper whose longitudinal tensile energy absorption index and lateral tensile energy absorption index as specified in JIS P8113: 2006 are 2.5 J/g or more and 1.0 J/g or more, respectively.
3. Clupak paper whose longitudinal tensile stiffness index and lateral tensile stiffness index as specified in ISO/DIS 1924-3 are 4.0 kN·m/g or more and 2.8 kN·m/g or more, respectively.
4. Clupak paper according to any one of 1 to 3, whose longitudinal tear index and lateral tear index as specified in JIS P-8116: 2000 are 12 mN·m$^2$/g or more and 20 mN·m$^2$/g or more, respectively.
5. Clupak paper according to any one of 1 to 4, whose freeness after disintegration as measured according to the measuring method specified in JIS P8121: 1995 based on pulp that has been disintegrated as specified in JIS P8220: 1998, is 400 to 700 ml.
6. A method for manufacturing Clupak paper, which is a method for manufacturing kraft paper according to any one of 1 to 5, using a gap-former paper-making machine equipped with a Clupak system.
7. A method for manufacturing Clupak paper according to 6, using pulp material containing pulp that has been beaten at high concentration.

Effects of the Invention

According to the present invention, high-quality Clupak paper that does not break easily when processed into and used as a sack can be provided because this Clupak paper has longitudinal tensile index, tear index, tensile energy absorption index, etc., in specified ranges and therefore offers an excellent longitudinal/lateral balance of elongation and strength.

MODE FOR CARRYING OUT THE INVENTION

The kraft paper under the present invention is particularly suited for use as the Clupak paper for heavy packaging specified as Kraft Paper Type 5-1 (basis weight ranging from 70 to 83 g/m$^2$) in JIS P3401: 2000. It can also be used in applications other than heavy packaging, for example, as a base paper for adhesive tape or base paper to be processed. Furthermore, it can be used in any of various kraft paper applications outside the ranges of paper quality and basis weight specified for Kraft Paper Type 5-1 mentioned above, so long as the quality stated in the present application for patent is satisfied.

Traditionally, gap-former paper-making machines are known to be suitable for making newspaper, tissue paper, and other paper of low basis weight at high speed. A gap-former paper-making machine is designed to inject pulp material upward from a head box and then cause the pulp material to immediately travel vertically as sandwiched in between two wires so that the pulp material is dewatered almost uniformly on both sides with reference to the wires, which makes high-speed paper making possible and reduces any difference the paper may have between the front surface and back surface compared to when a traditional Fourdrinier paper-making machine or on-top paper-making machine where pulp material travels horizontally is used. Preferably the head box is of concentration-adjustable type so that Clupak paper of uniform paper quality in the width direction of the paper-making machine can be manufactured.

According to the present invention, Clupak paper offering excellent strength characteristics can be obtained using a gap-former paper-making machine. The reasons for this are considered as follows. A vertical or inclined gap former, not a horizontal type, injects material upward and therefore the speed of material jet tends to decrease as the position energy rises. In the case of single-layer (one-layer) paper making with the vertical or inclined gap former, the process of paper layer formation in the thickness direction is presumed as such that the very front layer (and very back layer) of the paper is dewatered immediately when the material jet contacts the wires (state where the position energy is still low and the speed of material jet is still high) and a paper layer is formed; since the internal layer is dewatered more slowly than the very front layer (and very back layer), paper layer formation occurs in a state where the position energy is relatively high.

To be more specific, with the aforementioned vertical or inclined gap former, if the J/W ratio indicates a rush state (state where the speed of material jet is faster than the wire speed), for example, then the very front layer (and very back layer) of the paper is formed while the speed of material jet is relatively high, or in other words a difference speed of material jet and wire is retained, which means that the fiber orientation strength associated with the speed of material jet is high. On the other hand, the internal layer is formed in a state where the speed impact of material jet is relatively slower than for the front layer or back layer, or in other words the differential speed of material jet and wire is small, and consequently the fiber orientation strength associated with the speed of material jet is low. Accordingly, it is presumed that, although the specifics may vary depending on the manufacturing setting of J/W ratio, the fiber orientation strength of the very front layer (and very back layer) is different from the fiber orientation strength of the internal layer. This means that both areas of high fiber orientation strength and low fiber orientation strength are present in a single paper layer, thus allowing for paper offering excellent strength balance to be manufactured using a gap former.

Desirably, the base paper of the aforementioned Clupak paper has the characteristic values stated below. Any base paper having the characteristic values below offers excellent elongation and strength in the longitudinal direction (paper-making direction):

1. The longitudinal breaking elongation and lateral breaking elongation as specified in JIS P8113: 2006 are 2.2% or more and 4.0% or more, respectively, giving a longitudinal and lateral breaking elongation ratio (longitudinal/lateral) of 0.50 or more.
2. The longitudinal tensile energy absorption index and lateral tensile energy absorption index as specified in JIS P8113: 2006 are 1.5 J/g or more and 0.6 J/g or more, respectively, giving a longitudinal and lateral tensile energy absorption ratio (longitudinal/lateral) of 1.05 or more.
3. The longitudinal tear index and lateral tear index as specified in JIS P8116: 2000 are 10.0 $mN \cdot m^2/g$ or more and 18.0 $mN \cdot m^2/g$ or more, respectively, giving a longitudinal and lateral tear index ratio (longitudinal/lateral) of 1.00 or less.
4. The burst index as specified in JIS P-8112: 2008 is 3.8 kPa or more.
5. The longitudinal tensile stiffness index as specified in ISO/DIS 1924-3 is 7.0 kN·m/g or more.

Additionally, when manufacturing Clupak paper or other paper of high basis weight, the need for injecting a large amount of material causes the material to drop without reaching the wire if the speed of material jet is slow. An increase in the basis weight necessitates lowering of the paper-making speed to some extent in order to maintain a balance with the drying capability, and if a condition requiring a large amount of material is combined with a condition requiring lower paper-making speed, a "clogged screen" tends to occur as the fibers get tangled with the mesh screen instead of passing through it. This means that, to inject a large amount of material from the head box, the jet speed must be greater than the gravity and desirably the flow rate is fast enough to not cause a clogged screen. Under the present invention, therefore, preferably the jet speed is greater than the wire speed, and preferably the J/W ratio provides a push condition, especially between 103 and 130%, as it allows for stable operation.

Since Clupak paper has high basis weight, the paper-making speed is affected by the drying capability of the dryer part, as mentioned above. A large product of basis weight ($g/m^2$) and paper-making speed (m/min) leads to insufficient drying in the dryer part, while a small product causes the productivity to drop. To ensure both drying performance and productivity, therefore, under the present invention preferably paper-making is performed in conditions where the product of basis weight and paper-making speed falls between 20,000 and 50,000.

Also under the present invention, preferably the material pulp is cooked according to the kraft process to obtain unbleached or bleached kraft pulp, which is then refined (beaten) into a pulp slurry. When beaten, the pulp branches or swells in the length direction to become microfibrils associated with higher paper strength and elongation. Especially under the present invention, preferably beating is performed at a high concentration of 15 to 40% (or more preferably 20 to 30%). Beating at high concentration (HCR treatment) accelerates the branching or microfibrilization of the pulp to increase the breaking elongation, tensile energy absorption, tear strength, tensile strength, etc., of the paper. Under the present invention, the pulp beaten at high concentration may be used alone or mixed with pulp beaten at low concentration. When mixing, preferably the pulp beaten at high concentration accounts for 50 percent by weight or more.

Clupak paper made with a gap-former paper-making machine is simultaneously dewatered from the front and back in the wire part, so the paper contains less fine fibers and its strength tends to be lower than when a Fourdrinier paper-making machine or on-top paper-making machine is used. Under the present invention, therefore, preferably softwood is used as the material as it has longer fibers that are beneficial for strength improvement. The type of softwood is not limited in any way, but examples include Douglas fir, Japanese larch, spruce, Radiata pine, etc., which may be used alone or two or more types may be mixed. Preferably the ratio of softwood kraft pulp in the material pulp is 50 percent by weight or more relative to the total solid content by weight of the material pulp. Also, blending hardwood kraft pulp whose fibers are shorter than those of the aforementioned softwood kraft pulp, by less than 50 percent by weight (or preferably 5 to 30 percent), makes it possible to improve the formation of Clupak paper. The types of material pulp that can be combined with kraft pulp include recycled pulp and mechanical pulp.

It should be noted, however, that a clogged screen tends to occur when the primary material is softwood of long average fiber length; in light of this, operation can be made more stable by using a prepared pulp obtained by adjusting the concentration of beaten material pulp to between 0.1 and 1.0% and filtering it through a primary screen of 0.2 to 0.8 mm in slit width.

In the case of high-speed paper-making using a machine of large paper-making width (such as 5 m or more), the magnitude of tension that acts upon the paper, drying condition, and the like, are likely to differ between the two ends of the paper in the width direction and the center, for example, and the strength characteristics tend to become uneven as a result. Under the present invention, on the other hand, Clupak paper satisfying the desired elongation characteristics and strength characteristics in the width direction can be manufactured, even with a paper-making machine of large paper-making width, by means of paper making using a gap former for varying fiber orientation in the thickness direction, as well as by adjusting the high-concentration beating, concentration, J/W ratio, etc., as mentioned above.

In general, it is known that the lower the breaking elongation of paper, the more easily the paper breaks. However, Clupak paper to which longitudinal elongation has been added by the Clupak process is known to be more resistant to breaking in sack form compared to kraft paper not undergoing the Clupak process. Still, Clupak process causes the paper to shrink by applying excess force on it in the longitudinal direction, so its tensile strength in the longitudinal direction drops. Particularly in recent years, with the progress of automation of filling machines, the filling process of pinching the top of the sack and then letting the content drop into the sack by gravity involves an application of large force in the longitudinal direction. As a result, the possibility of the sack breaking during filling can be reduced more when the sack has greater strength characteristics in the longitudinal direction.

The specific strength characteristics in the longitudinal direction include longitudinal tensile index and tensile energy absorption index, and lateral tear strength, among others. By maintaining these characteristics at certain levels, breaking of the sack can be suppressed even after the Clupak process. The base paper under the present invention has high longitudinal tensile strength and breaking elongation, so the pressurization condition and other settings in the subsequent Clupak process can be lowered, which in turn reduces mechanical damage to the base paper and suppresses dropping of its strength characteristics in the longitudinal direction.

The manufacturing method using this Clupak system is such that a paper web is inserted between a roll and an endless rubber blanket to compress the paper web with a nip bar and the rubber blanket, while at the same time the pre-stretched blanket shrinks to cause the paper web to also shrink and thereby increase its breaking elongation. The Clupak system allows for adjustment of the breaking elongation of kraft paper in the longitudinal direction according to the ratio of the manufacturing speed on the inlet side of the Clupak system and manufacturing speed on the outlet side of the Clupak system, and also according to the pressurization force applied by the nip bar.

Normally the Clupak system is installed on a paper-making machine in a location surrounded by a group of dryers, so that excess water is removed after desired creping.

The moisture content of wet paper in a certain position inside the dryer varies depending on the relationship between the paper-making speed of the paper-making machine and the basis weight of the paper, but when the Clupak system is installed, too low a moisture content of the paper passing through the system makes it difficult to achieve sufficient paper elongation, while too high a moisture content causes the paper to break more easily, and therefore preferably the paper is passed between a Clupak blanket and Clupak dryer cylinder in a condition where the wet paper contains 20 to 45% moisture. A more preferable moisture content is 30 to 45%.

Preferably the nip pressure of the Clupak blanket and Clupak dryer cylinder is 20 kN/m or more because too low a pressure reduces the shrinking of the nip outlet. Preferably the surface temperature of the Clupak dryer cylinder is 100 to 120° C. to facilitate expression of elongation, and this temperature can be adjusted by controlling the vapor pressure at the inlet of the dryer cylinder.

The aforementioned ratio of the manufacturing speed on the outlet side of the Clupak system and manufacturing speed on the inlet side of the Clupak system is called the "draw ratio," and the percentage ratio by which to make the manufacturing speed on the outlet side slower than the manufacturing speed on the inlet side is called the "negative draw percent," where the negative draw is set in a range of −3% to −8% (or preferably −4% to −7%) in order to process Clupak paper into a heavy sack that does not break easily.

Under the present invention, desirably the longitudinal tensile energy absorption (TEA) index of the kraft paper as specified in JIS P8113: 2006 is 2.5 J/g or more, or preferably 2.7 J/g or more, or more preferably 2.9 J/g or more, while desirably the lateral tensile energy absorption index is 1.0 J/g or more, or preferably 1.2 J/g or more, or more preferably 1.4 J/g or more.

Tensile energy absorption index refers to the amount of energy per unit area needed to cause the material to break. The Clupak process tends to increase the longitudinal breaking elongation of the paper, but decreases its longitudinal tensile index. So long as both the longitudinal tensile energy absorption index and lateral tensile energy absorption index, especially longitudinal tensile energy absorption index, remain(s) in the aforementioned range(s), the paper will absorb the energy and rarely break even when it is processed into and used as a sack and a large force is applied to the sack.

Also under the present invention, the longitudinal tensile index of the kraft paper as specified in JIS P8113: 2006 must be 60 N·m/g or more, or preferably 65 N·m/g or more, or more preferably 70 N·m/g or more, while the lateral tensile index must be 28 N·m/g or more, or preferably 30 N·m/g or more, or more preferably 32 N·m/g or more. If the longitudinal tensile index and lateral tensile index are less than 60 Nm/g and less than 28 N·m/g, respectively, the sack will not offer sufficient strength when in use and may break.

Furthermore under the present invention, desirably the longitudinal tear index of the kraft paper as specified in JIS P-8116: 2000 is 12 mN·m$^2$/g or more, or preferably 14 mN·m$^2$/g or more, or more preferably 16 mN·m$^2$/g or more, while desirably the lateral tear index is 20 mN·m$^2$/g or more, or preferably 22 mN·m$^2$/g or more, or more preferably 24 mN·m$^2$/g or more.

Also under the present invention, desirably the longitudinal tensile stiffness index as specified in ISO/DIS 1924-3 is 4.0 kN·m/g or more, or preferably 4.2 kN·m/g or more, or more preferably 4.4 kN·m/g or more, while desirably the lateral tensile stiffness index is 2.8 kN·m/g or more, or preferably 3.0 kN·m/g or more, or more preferably 3.2 kN·m/g or more. If the longitudinal tensile stiffness index and lateral tensile stiffness index are less than 4.0 kN·m/g and less than 2.8 kN·m/g, respectively, the paper will not become stiff enough and ease of handling will drop, thus making it more difficult to process the paper into a sack, etc.

Also under the present invention, the freeness after disintegration of the kraft paper as measured by the measuring method specified in JIS P8121: 1995, based on the pulp disintegrated as specified in JIS P8220: 1998, is preferably 400 to 700 ml, or more preferably 500 to 650 ml. In the context of the present invention, the freeness after disintegration refers to the freeness of the kraft paper measured after disintegration, or specifically the value of freeness measured by disintegrating the paper as specified in JIS P8220 and then measuring the disintegrated paper by the measuring method specified in JIS P8121. So long as its freeness after disintegration is in a range of 400 to 700 ml, the air resistance of the kraft paper can be kept in a range of 10 to 25 seconds, which means that, when the paper is used for heavy packaging of grain, etc., the content can be preserved more properly. If the freeness after disintegration is less than 400 ml, on the other hand, the tensile strength, tear strength, etc., of the kraft paper tend to drop.

As described above, the Clupak paper under the present invention is manufactured in such a way that its strengths fall within specified ranges, so when it is used as a sack, etc., to contain grain, inorganic powder, granules, or gravel-like objects, in particular, breaking of the sack due to the load or shifting of the content can be prevented.

The present invention is explained in detail below based on examples. It should be noted, however, that the present invention is not limited to these examples. Also, parts and percents represent parts by weight and percents by weight, respectively, unless otherwise specified.

Example 1

Heavy-duty Clupak paper having a basis weight of 84.9 g/m$^2$ was made using a gap-former paper-making machine equipped with a Clupak system, at a paper-making speed of 480 m/min and using, as material, 100% unbleached softwood kraft pulp that had been beaten at high concentration of 28%. The negative draw on the Clupak was set to −4.5%.

Example 2

Heavy-duty Clupak paper was made in the same manner as in Example 1, except that the paper had a basis weight of 76.1 g/m$^2$ and the negative draw on the Clupak was set to −6.0%.

Example 3

Heavy-duty Clupak paper was made in the same manner as in Example 1, except that the paper had a basis weight of 73.4 g/m$^2$ and the negative draw on the Clupak was set to −4.0%.

Example 4

Heavy-duty Clupak paper was made in the same manner as in Example 1, except that the paper had a basis weight of 85.0 g/m$^2$, the negative draw on the Clupak was set to −4.0%, and the pulp blend consisted of 90% unbleached softwood kraft pulp and 10% unbleached hardwood kraft pulp.

Comparative Example 1

Heavy-duty Clupak paper was made in the same manner as in Example 1, except that the paper had a basis weight of 71.9 g/m$^2$ and the negative draw on the Clupak was set to −10.0%.

Comparative Example 2

Heavy-duty Clupak paper was made in the same manner as in Example 1, except that the paper had a basis weight of 85.4 g/m$^2$ and the negative draw on the Clupak was set to −1.0%.

Comparative Example 3

Heavy-duty kraft paper was made in the same manner as in Example 1, except that the paper had a basis weight of 76.0 g/m$^2$ and the Clupak process was not performed.

TABLE 1

| | | Clupak negative draw | Basis weight | Paper thickness | Density | Air resistance | Tensile index Nm/g | | Elongation at break % | | TEA index J/g | | Tensile stiffness index kNm/g | | Tear index mN · m$^2$/g | | Formation | Breaking after processsed into heavy-duty sack |
|---|---|---|---|---|---|---|---|---|---|---|---|---|---|---|---|---|---|---|
| | | % | g/m$^2$ | μm | g/cm$^3$ | sec | MD | CD | MD | CD | MD | CD | MD | CD | MD | CD | | |
| Examples | 1 | −4.5 | 84.9 | 121 | 0.70 | 14 | 88.1 | 31.3 | 7.0 | 7.1 | 3.55 | 1.55 | 5.62 | 3.64 | 12.8 | 28.9 | ○ | ○ |
| | 2 | −6.0 | 76.1 | 118 | 0.65 | 12 | 69.5 | 33.0 | 8.1 | 5.8 | 3.22 | 1.47 | 4.18 | 3.07 | 19.7 | 25.8 | ○ | ○ |
| | 3 | −4.0 | 73.4 | 110 | 0.67 | 13 | 72.5 | 30.1 | 6.0 | 6.0 | 2.60 | 1.17 | 4.95 | 3.43 | 14.9 | 20.3 | ○ | ○ |
| | 4 | −4.0 | 85.0 | 129 | 0.66 | 13 | 83.3 | 39.4 | 7.4 | 6.3 | 3.47 | 1.51 | 5.33 | 3.44 | 13.1 | 25.5 | ◎ | ○ |
| Comparative Examples | 1 | −10.0 | 71.9 | 112 | 0.64 | 12 | 52.0 | 28.0 | 10.6 | 5.3 | 3.47 | 1.02 | 3.09 | 3.14 | 19.7 | 27.1 | ○ | X |
| | 2 | −1.0 | 85.4 | 130 | 0.66 | 15 | 85.0 | 32.1 | 3.7 | 6.7 | 1.99 | 1.49 | 7.12 | 3.70 | 16.3 | 20.4 | ○ | X |
| | 3 | Not used | 76.0 | 119 | 0.64 | 18 | 92.1 | 35.5 | 3.3 | 5.4 | 1.89 | 1.49 | 8.92 | 3.85 | 19.1 | 24.9 | ○ | ○ |

Evaluation Methods (Measurement of Tensile Energy Absorption Index)

Measured by the method specified in JIS P8113: 2006.

(Measurement of Breaking Elongation)

Measured by the method specified in JIS P8113: 2006.

(Measurement of Tear Index)

Measured by the method specified in JIS P8116: 2000.

(Measurement of Burst Index)

Measured by the method specified in JIS P8112: 2008.

(Measurement of Tensile Stiffness Index)

Measured by the method specified in ISO/DIS 1924-3.

(Measurement of Freeness after Disintegration)

Measured by the method specified in JIS P8220: 1998 and JIS P8121: 1995.

Looking at the properties of the Clupak papers in Examples 1 to 4 and Comparative Examples 1 and 2 as well as those of the kraft paper in Comparative Example 3, as shown in Table 1, the Clupak papers described in Examples 1 to 4 exhibit a good balance of various strengths and elongation and have excellent strength overall; on the other hand, the Clupak papers described in Comparative Examples 1 and 2 and kraft paper described in Comparative Example 3 exhibit a poor balance of various strengths and elongation and cannot be said to have excellent strength overall.

What is claimed is:

1. Clupak paper whose longitudinal tensile index and lateral tensile index as specified in JIS P8113: 2006 are 60 N·m/g or more and 28 N·m/g or more, respectively, and longitudinal tensile energy absorption index and lateral tensile energy absorption index as specified in JIS P8113: 2006 are 2.5 J/g or more and 1.0 J/g or more, respectively.

2. Clupak paper according to claim 1, whose longitudinal tensile stiffness index and lateral tensile stiffness index as specified in ISO/DIS 1924-3 are 4.0 kN·m/g or more and 2.8 kN·m/g or more, respectively.

3. Clupak paper according to claim 2, whose longitudinal tear index and lateral tear index as specified in JIS P-8116: 2000 are 12 mN·m2/g or more and 20 mN·m2/g or more, respectively.

4. Clupak paper according to claim 2, whose freeness after disintegration as measured according to a measurement method specified in JIS P8121: 1995 based on pulp that has been disintegrated as specified in JIS P8220: 1998, is 400 to 700 ml.

5. Clupak paper according to claim 1, whose longitudinal tear index and lateral tear index as specified in JIS P-8116: 2000 are 12 mN·m2/g or more and 20 mN·m2/g or more, respectively.

6. Clupak paper according to claim 5, whose freeness after disintegration as measured according to a measurement method specified in JIS P8121: 1995 based on pulp that has been disintegrated as specified in JIS P8220: 1998, is 400 to 700 ml.

7. Clupak paper according to claim 1, whose freeness after disintegration as measured according to a measurement method specified in JIS P8121: 1995 based on pulp that has been disintegrated as specified in JIS P8220: 1998, is 400 to 700 ml.

8. Clupak paper according to claim 1, whose basis weight ranges from 70 to 85 g/$m^2$.

* * * * *